US010132339B2

(12) United States Patent
Conrad

(10) Patent No.: US 10,132,339 B2
(45) Date of Patent: Nov. 20, 2018

(54) IONIZING PUMP STAGE

(71) Applicant: Pfeiffer Vacuum GmbH, Asslar (DE)

(72) Inventor: Armin Conrad, Herborn (DE)

(73) Assignee: Pfeiffer Vacuum GmbH, Asslar (DE)

( * ) Notice: Subject to any disclaimer, the term of this patent is extended or adjusted under 35 U.S.C. 154(b) by 408 days.

(21) Appl. No.: 14/105,703

(22) Filed: Dec. 13, 2013

(65) Prior Publication Data

US 2014/0169986 A1 Jun. 19, 2014

(30) Foreign Application Priority Data

Dec. 17, 2012 (DE) ..... 10 2012 223 450

(51) Int. Cl.
*F15D 1/00* (2006.01)
*H01J 41/12* (2006.01)

(52) U.S. Cl.
CPC ..... *F15D 1/0075* (2013.01); *H01J 41/12* (2013.01)

(58) Field of Classification Search
CPC ..... F04B 37/00; F04B 37/14; F15D 1/0075; H01J 41/12; H01J 41/16; H01J 41/20; H01J 37/32431
USPC ..... 417/48, 50, 205, 49
See application file for complete search history.

(56) References Cited

U.S. PATENT DOCUMENTS 2,182,751 A 12/1939 Reitherman
3,156,842 A 11/1964 McClure
4,631,002 A 12/1986 Pierini
5,899,666 A * 5/1999 Chung ..... H01J 41/18 417/48
6,559,601 B1 5/2003 Johnson
2010/0067164 A1* 3/2010 Goudy, Jr. ..... B03C 3/08 361/225
2013/0153763 A1 6/2013 Saint

FOREIGN PATENT DOCUMENTS

DE 4243860 7/1994
DE 10 2009 042 417 A1 1/2011

OTHER PUBLICATIONS

Hatch, Aluminum—Properties and Physical Metallurgy, 1984, American Society for Metals, pp. 4-5, 91.*
Search Report of German Patent Office.

* cited by examiner

*Primary Examiner* — Patrick Hamo
(74) *Attorney, Agent, or Firm* — Abelman, Frayne & Schwab

(57) ABSTRACT

The invention relates to an ionizing pump stage, in particular for a vacuum pump, comprising an inlet for gas entering into the pump stage; an ionizing section communicating with the inlet in a gas-conductive manner and an ionizing device for ionizing the gas entered into the ionizing section; an acceleration device for accelerating the ionized gas present in the ionizing section in the conveying direction; and a neutralizing section following the ionizing section in the conveying direction and communicating with the ionizing section in a gas-conductive manner and a neutralizing device for the electrical neutralizing of the ionized gas entering into the neutralizing section.

14 Claims, 2 Drawing Sheets

IONIZING PUMP STAGE

BACKGROUND OF THE INVENTION

1. Field of the Invention

The present invention relates to an ionizing pump stage, in particular for a vacuum pump.

2. Description of the Prior Art

Different types of vacuum pumps and of pump stages for vacuum pumps are known which differ e.g. with respect to their suction capacities and the minimal vacuum pressures which can be produced. Turbomolecular pumps, cryopumps, ion getter pumps and titanium sublimation pumps represent conventional vacuum pumps, for example. The maximum suction capacity and accordingly the Ho factor which is given by the quotient of the maximum suction capacity and the inlet admittance of the pump are restricted in the turbomolecular pumps in particular used in the high vacuum area for producing very low vacuum pressures. In addition, the suction capacity and thus the Ho factor of these pumps depend on the molecular mass of the pumped gases and decrease as the molecular mass decreases, i.e. only a lower suction capacity can be achieved for light gases. Furthermore, in particular those vacuum pumps which are suitable for producing a very high vacuum have a complex design so that their manufacture is correspondingly complicated and/or expensive.

It is therefore the object of the invention to provide a pump stage, preferably for a vacuum pump, which has a high suction capacity and a high Ho factor, in particular also for light gases, and which can moreover be operated reliably and with low wear and low maintenance and which can be manufactured with a small effort and/or at a small cost.

SUMMARY OF THE INVENTION

The object of the invention is achieved by an ionizing pump stage, in particular for a vacuum pump, comprising:

- an inlet for gas entering into the pump stage;
- an ionizing section communicating with the inlet in a gas-conductive manner and an ionizing device for ionizing the gas entered into the ionizing section;
- an acceleration device for accelerating the ionized gas present in the ionizing section in the conveying direction of the gas; and
- a neutralizing section following the ionizing section in the conveying direction and communicating with the ionizing section in a gas-conductive manner and a neutralizing device for the electrical neutralizing of the ionized gas entering into the neutralizing section.

It has been found that a pump stage having the above-described simple design in particular also achieves an efficient pumping effect for light gases which results in a very high suction capacity of the pump stage which can amount to a multiple of the suction capacity of a turbomolecular pump so that an accordingly high Ho factor and a high idling compression of the pump stage can be achieved.

The pumping effect is based on the ionizing of the gas molecules entering from the vacuum chamber to be evacuated via the inlet into the ionizing section. The ionized gas molecules are accelerated in the conveying direction by the acceleration device and as a result enter into the neutralizing section following the ionizing section in the conveying direction where they are electrically neutralized. The electrically neutral gas molecules only diffuse back in the direction of the ionizing section with a low probability predefined by the thermal movement of the gas molecules so that the gas molecules are collected in the neutralizing section and a pumping effect is produced which is directed from the inlet to the neutralizing section of the pump stage. The pump stage in this respect satisfies the function of a "molecular diode" since the molecules are conveyed in one direction, namely from the inlet to the neutralization section, but not in the reverse direction.

A high pump power, i.e. in particular a high suction capacity, a high Ho factor and a high idling compression, can be achieved using the above-described pump principle independently of the molecular mass of the conveyed gases.

The ionizing pump stage is in this respect in particular suitable as a pump stage disposed upstream of a further pump stage such as a turbomolecular pump stage in the flow direction or as a booster for the further pump stage, with a multiplication of the pump power being achieved with respect to a purely turbomolecular pump, in particular for light gases.

The ionizing pump stage has a very simple design and can accordingly be realized inexpensively and in a small construction space. The pump stage can in principle manage without any rotating and/or otherwise moving parts, whereby vibrations, noise developments and collisions of moving pats as well as associated damage are avoided. The ionizing pump stage therefore proves very safe, reliable, low-wear and low-maintenance in operation and has a high service life. In addition, a lubrication of moving or rotating components can be dispensed with, i.e. the ionizing pump stage can be configured as a dry pump stage, whereby a contamination of the volume to be evacuated by lubricants or corresponding operating media and the achievable purity of the vacuum can be improved.

The performance behavior of the ionizing pump stage can be directly adapted by a corresponding setting of the ionizing parameters and acceleration parameters and can thus be optimized for different operating conditions and in particular for different ranges of the inlet pressure and/or outlet pressure of the pump stage. A vacuum pump having a modular design which has a desired pumping behavior can be produced in a simple manner by connecting in series or in parallel in a gas-conductive manner a plurality of ionizing pump stages configured in accordance with the invention.

In accordance with an embodiment, the neutralization section is at least approximately completely separated from the inlet by the ionizing section. It is thereby at least very largely prevented that the gas located in the pump stage moves from the neutralizing section past the ionizing section back to the inlet. Instead, the gas can preferably only move out of the neutralizing section through the ionizing section back to the inlet. Since the gas molecules are ionized with high probability on the path through the ionizing section and are thereupon again accelerated back to the neutralizing section, a return of the conveyed gas molecules to the inlet is largely prevented. A high suction capacity and a high idling compression of the ionizing pump stage are thereby achieved.

To realize the described separation, the ionizing section can extend at least at one point over at least approximately the total gas-conductive cross-section of the conveying space for the gas formed by the ionizing pump, with the inlet being arranged on the one side and the neutralizing section being arranged on the other side of the ionizing section. If a gas path past the ionizing section back to the inlet is nevertheless provided in the pump stage, the conveying capacity defined by the gas-conductive geometry of this gas path or its gas conduction value preferably amounts to at most 15%, further preferably at most 5% and further preferably at most 1% of the conveying capacity of the ionizing section or of its gas conduction value given by the gas-conductive geometry of the ionizing section.

The ionizing device preferably has at least one ionizing structure for ionizing the gas which is preferably arranged in or bounds the ionizing section of the conveying space. The ionizing structure can be acted on by an electrical DC voltage potential or by an electrical AC voltage potential in particular of high frequency. The structure can be connected for this purpose to a corresponding electrical current source or voltage source. The value of the DC voltage potential or of the effective value or nominal value of the AC voltage potential is in this respect preferably adapted to ionize the gas molecules to be pumped once or a multiple of times, with the gas molecules preferably being gas molecules from the group comprising molecules of hydrogen ($H_2$), oxygen ($O_2$), nitrogen ($N_2$), carbon monoxide (CO) or carbon dioxide ($CO_2$).

The ionizing structure preferably comprises an electrode or is configured as an electrode, with e.g. a hot cathode or a cold cathode being able to be used. The ionizing can in this respect take place by contact of the gas molecules with the electrode preferably arranged in or bounding the ionizing section. The ionizing device can be configured to give the gas molecules a positive charge, i.e. such that the gas molecules emit one or more electrons during the ionizing. The electrode can be adapted by its design to the purpose of use and e.g. to the pressure range in which the ionizing pump stage is to be used.

A degree of ionization given by the quotient from the number of the ionized gas molecules present in the ionizing section to the total number of the gas molecules present in total in the ionizing section in the operation of the pump is preferably ensured of at least 1%, preferably at least 3%, further preferably at least 5%, and further preferably at least 10%.

In accordance with an advantageous embodiment, the acceleration device has an accelerating structure which can have one or more openings, in particular channel-like or tunnel-like openings, which preferably form a grid structure or tunnel structure of the acceleration structure and which are preferably oriented parallel to one another. Such a structure is particularly suited to accelerate the ionized gas molecules present in the ionizing section in the conveying direction. The openings or channels are preferably elongated and preferably have a length which is larger than the width and/or height of the openings, with the ratio between the length of an opening and its width and/or height being able to amount to at least 2, preferably to at least 3, and further preferably to at least 5. An even more effective acceleration in the conveying direction is achieved by a larger length of the channels, whereby the $H_o$ factor and the idling compression of the pump stage are improved.

The acceleration structure is preferably arranged in an acceleration section and/or bounds the acceleration stage which is arranged in the conveying direction between the ionizing section and the neutralization section and connects the ionizing section and the neutralizing section to one another in a gas-conductive manner. The ionized gas molecules can then fly through the acceleration section to move out of the ionizing section into the neutralizing section. One or more openings of the acceleration structure as described above, in particular tunnel-like or channel-like openings, preferably connect the ionizing section and the neutralizing section and are flown through by the gas molecules, with the openings preferably being oriented in the conveying direction. A particularly effective acceleration in the desired direction can thereby be achieved.

The neutralizing section is preferably at least approximately completely separated from the inlet by the acceleration section, and indeed in particular in the manner described above with respect to the ionizing section. It is thereby ensured that the gas from the neutralizing section can only move through the acceleration section and preferably following this through the ionizing section back to the inlet. The acceleration section can in this respect likewise extend over substantially the total cross-section of the conveying space of the pump stage.

The acceleration device or its acceleration structure is preferably configured to produce an electrical acceleration field for accelerating the ionized gas molecules present in the ionizing section. The acceleration structure can preferably be acted on by an electrical acceleration potential for this purpose, with it being able to be a DC voltage potential. The structure can be connected for this purpose to an electrical current source or voltage source. The acceleration structure can have an electrode or can be configured as an electrode which can in particular have a grid structure or tunnel structure as described above.

The electrical acceleration field is directed, while taking account of the polarity of the ionized gas molecules produced in the ionizing section, such that the ions are accelerated in the conveying direction. The ionized gas molecules present in the ionizing section are preferably attracted by the electrical acceleration field and are accelerated in the direction of the acceleration structure and thereupon fly through the openings or channels of the acceleration structure to enter into the neutralizing section. In accordance with the preferably positive electrical charge of the ionized gas molecules, a negative electrical potential is preferably applied to the acceleration structure to generate an attracting acceleration field. The amount of the acceleration potential can in this respect amount to at least 0.2 kV, preferably to at least 0.7 kV, further preferably to at least 1.9 kV and further preferably to at least 17 kV.

The neutralizing device serves for the neutralizing of the ionized gas molecules present in the neutralizing section. The neutralizing device preferably has a neutralizing structure arranged in the neutralizing section and/or bounding the neutralizing section. The neutralizing structure can preferably be acted on by a neutral electrical potential, in particular by a ground potential, and can be connected for this purpose to a ground terminal which provides a neutral electrical potential. The ionized gas molecules conveyed from the ionizing section into the neutralizing section preferably comes into contact with the neutralizing structure for the electrical neutralizing.

The neutralizing structure can be formed by an electrode and can have any desired shape and geometry which is preferably configured such that the ionized gas molecules conveyed from the ionizing section into the neutralizing section come into contact with the neutralizing structure with a high probability. In a particularly simple case, the neutralizing structure is at least partly formed by a wall of the ionizing pump stage which bounds the neutralizing section.

It is possible in principle that the neutralizing structure is at least regionally formed by a material such as a getter material adsorbing the conveyed gas molecules.

It is, however, not necessary within the framework of the invention to catch the conveyed gas molecules in the neutralizing section by a getter material since the pump principle based on the electrical neutralizing also ensures a high-power pumping effect without such a getter material. The use of a getter material in the neutralizing section for catching the molecules can thus in principle be dispensed with and the effort associated therewith can be avoided.

Accordingly, the surface of the neutralizing structure can at least regionally comprise a material at which gas molecules to be conveyed are not adsorbed or are only adsorbed to a small degree or with a small probability. The molecules which are present in the neutralizing section and which come into contact with these regions of the surface are then not adsorbed, but are reflected by the material with a high probability and thus remain in the gaseous state. The gas molecules to be conveyed can in particular be selected from the group comprising molecules of hydrogen ($H_2$), oxygen ($O_2$), nitrogen ($N_2$), carbon monoxide (CO) and carbon dioxide ($CO_2$).

The material can thus be selected such that the gas molecules to be conveyed have a relatively small adsorption energy with respect to the material, i.e. an adsorption energy ($E_{ad}$) of e.g. less than 1 eV, preferably less than 0.5 eV, and further preferably less than 0.25 eV being released from the free gaseous state in a hypothetical adsorption. The adhesion probability ($_{s0}$) of the gas molecules to be conveyed with respect to the respective material at room temperature can amount to less than 5%, preferably less than 1%, and further preferably less than 0.1%. Example materials for the surface of the neutralizing structure are metallic materials such as steel, in particular stainless steel, aluminum, or alloys which contain steel, stainless steel and/or aluminum.

In accordance with an advantageous embodiment, the pump stage or a conveying space for the gas formed by the pump stage has a cylindrical basic shape. Such a shape is particularly suitable for manufacturing a compact and simultaneously high-power pump stage. Furthermore, such a shape is particularly favorable in a construction aspect when the ionizing pump stage is combined with further pump stages of the same type or with another pump stage, in particular of a conventional type, such as a turbomolecular pump stage. The ionizing section and the neutralizing section preferably follow one another in an axial direction or in a radial direction. If the pump stage, as described above, comprises an acceleration section through which the gas molecules are conveyed, it is preferred if the ionizing section, the acceleration section and the neutralizing section following one another in this order in the axial direction or in the radial direction.

In accordance with a further advantageous embodiment, the pump stage has an $H_o$ factor defined by the quotient from the suction capacity and the idling compression of at least 30%, preferably at least 50%, particularly preferably at least 70%, and most preferably at least 90%. Such a pump stage is particularly suited for producing a very high vacuum even at high gas loads.

In accordance with a further embodiment, an outlet for leading off the gas from the neutralizing section is provided following the neutralizing section in the conveying direction and connected thereto in a gas-conductive manner. The outlet of the ionizing pump stage can be connected to a further pump stage in a gas-conductive manner. For example, the outlet of the ionizing pump stage can be connected to the outlet of the further pump stage if the two pump stages are connected in parallel in a gas-conveying manner. In this case, the two inlets of the pump stages can also be connected to one another. The outlet of the ionizing pump stage can equally be connected to the inlet of the further pump stage so that the two pump stages are connected in series in a gas-conveying manner.

The ionizing pump stage can comprise an inlet flange and/or outlet flange which forms the inlet or the outlet of the ionizing pump stage, with the pump stage being connectable to a vacuum chamber or to a recipient and/or to a further pump stage, for example, via the respective flange.

A further subject of the invention is a vacuum pump which comprises at least one ionizing pump stage in accordance with the invention in accordance with the present description. The advantageous embodiments and advantages described with respect to the ionizing pump stage in the present description represent advantageous embodiments and advantages of the vacuum pump on a corresponding use.

In accordance with an advantageous embodiment, the vacuum pump has a plurality of ionizing pump stages as described herein. The ionizing pump stages are in this respect preferably connected in series or in parallel with respect to the conveyed gas flow. In this manner, an extremely high-power vacuum pump can be provided whose power characteristic can be flexibly adapted to the respective requirements by a corresponding combination and interconnection of the ionizing pump stages.

In accordance with an advantageous embodiment, the at least one ionizing pump stage is followed in the conveying direction by at least one further pump stage which is preferably connected in series to the ionizing pump stage in a gas-conveying manner, with the further pump stage being able to serve as a roughing stage with respect to the ionizing pump stage. The further pump stage is particularly preferably configured as a turbomolecular pump stage. It has been found that a vacuum pump having excellent pump properties and in particular a substantially increased suction capability and an increased idling compression in comparison with a purely turbomolecular pump stage can be provided by the combination of the ionizing pump stage with a downstream turbomolecular pump stage, and indeed substantially independently of the molecular mass of the conveyed gas molecules.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
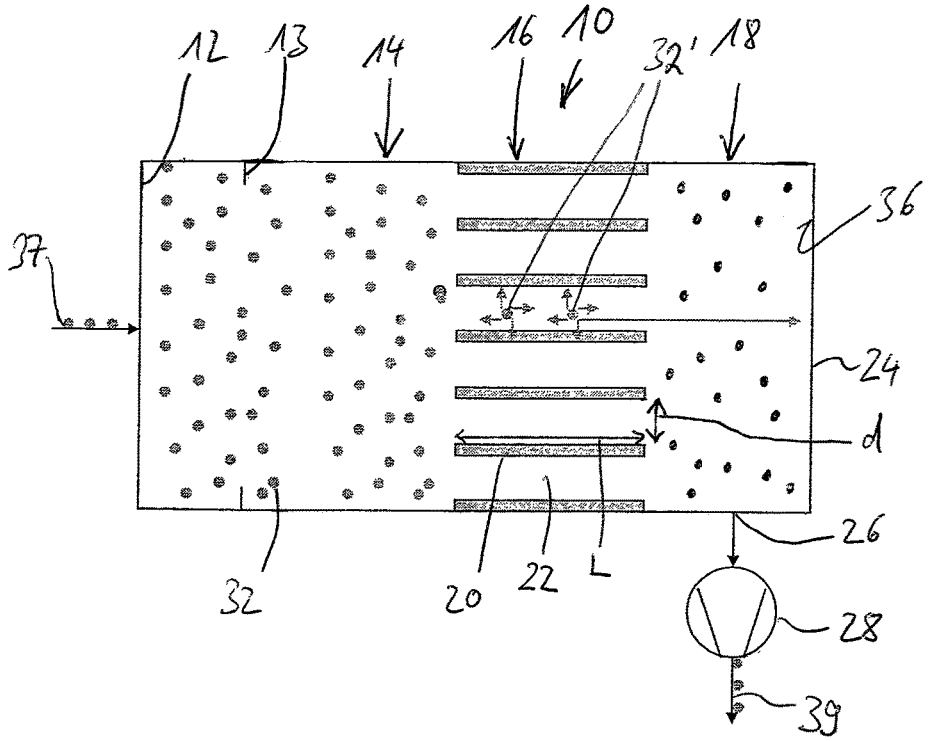
FIG. 1 a vacuum pump having an ionizing pump stage in accordance with the invention in accordance with an embodiment of the invention.

FIG. 1 shows a vacuum pump having an ionizing pump stage 10 in accordance with an embodiment of the invention.

The ionizing pump stage 10 comprises an inlet 12 through which the gas can enter from a volume to be evacuated into the conveying space of the ionizing pump stage 10. A plurality of gas molecules are shown by way of example and as exaggeratedly large in FIG. 1 and are provided with the reference numeral 32 and 32' respectively. A gas molecule 32, 32' is in principle also to be understood as a single gas atom. Accordingly, an ionized gas molecule 32, 32' is to be understood both as an ionized gas molecule, i.e. a gas molecule electrically charged once or a multiple of times, comprising a plurality of atoms and also as an ionized gas atom.

Following the inlet 12 in the conveying direction, a baffle 13 is provided with which the cross-section of the conveying space and thereby the amount of the gas can be regulated which enters into the sections of the conveying space of the pump stage 10 following the baffle 13, i.e. into the ionizing section 14, into the acceleration section 16 and into the neutralizing section 18.

The ionizing section 14 follows the baffle 13 in the conveying direction and is arranged such that the gas molecules 32, 32' present in said ionizing section are ionized by a corresponding ionizing device not shown in FIG. 1, with the gas molecules 32, 32' being positively charged in the present case, i.e. emitting electrons on the ionizing. The ionizing device can, for example, comprise an electrode arranged in or bounding the ionizing section 14 and being able to be acted on by an electrical DC voltage potential or AC voltage potential.

The acceleration section 16 is provided following the ionizing section 14 in the conveying direction. An acceleration structure 20 is arranged in the acceleration section 16. The structure 20 is formed by a grid-shaped electrode which has an electrical charge opposite to the electrical charge of the ionized gas molecules 32, 32', i.e. negative in the present case, so that the ionized gas molecules 32, 32' are attracted by the acceleration structure 20 and are accelerated in the conveying direction.

The acceleration structure 20 has channel-like openings 22 which extend in parallel with one another in the conveying direction and which have a relatively large aspect ratio, i.e. a ratio of length L to the cross-sectional diameter d. The channels 22 connect the ionizing section 14 in a gas-conductive manner to the neutralizing section 18 following the acceleration section 16 in the conveying direction so that the ionized gas molecules 32, 32' enter through the acceleration section 16 into the neutralizing section 18 as is indicated in FIG. 1 for the example of two ionized gas molecules 32'.

The wall 24 of the pump stage 10 surrounding the neutralizing section 18 and its surface 36 bounding the conveying chamber are acted on by an electrically neutral potential. When the gas molecules 32, 32' entering into the neutralizing section 18 come into contact with the surface 36, they are electrically neutralized, i.e. they reabsorb previously emitted electrons. In the region of the surface 36, the wall 24 can at least regionally have a material which admittedly electrically neutralizes the conveyed gas molecules 32, 32', but does not adsorb them or only adsorbs them with a small probability.

While the ionized gas molecules 32, 32' present in the ionizing section 14 are accelerated in the direction of the neutralizing section 18, the movement of the neutralized gas molecules 32, 32' present in the neutralizing section 18 is essentially determined by their thermal movement and is consequently substantially undirected. The thermally induced back diffusion of neutralized gas molecules 32, 32' in the direction of the ionizing section 14 is thus much smaller than the electrically accelerated conveying of gas molecules 32, 32' from the ionizing section 14 into the neutralizing section 18 so that an efficient pumping effect results.

Following the neutralizing section 18 in the conveying direction, an outlet 26 is arranged which is connected to the neutralizing section 18 in a gas-conductive manner and which is connected in a gas-conductive manner to the inlet of a further pump 28 connected downstream of the ionizing pump stage 10. In particular when the pump stage 28 is a turbomolecular pump stage, an extremely high-power vacuum pump is provided in this manner. The conveying effect of the total vacuum pump is illustrated by arrows 37, 39 in FIG. 1.

Figure 2:
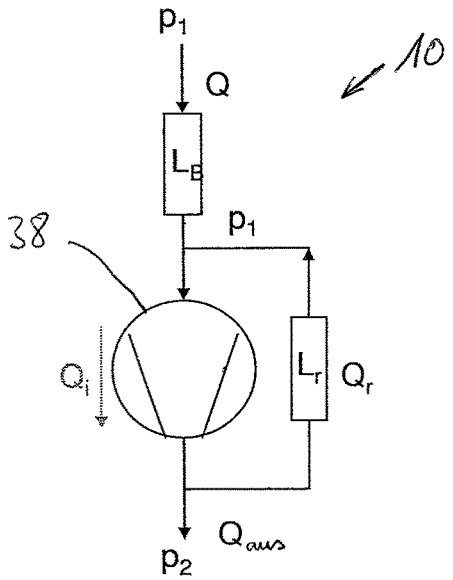
FIG. 2 a schematic representation of a flow model of the ionizing pump stage of FIG. 1.

FIG. 2 shows a schematic representation of a flow model of the ionizing vacuum pump stage 10 of FIG. 1 with reference to which the pumping effect and the power properties of this pump stage 10 are explained in the following.

The arrows in FIG. 2 indicate the flow direction of the gas. The gas to be pumped out which enters via the inlet 12 of the pump stage 10 has an inlet pressure p1. This pressure p1 produces a gas flow Q through the inlet 12 and the baffle 13 (FIG. 1) which depends on an admittance value LB which can be varied by varying the opening cross-section of the baffle 13, with the gas entering through the inlet 12 and the baffle 13 having an intermediate pressure p1'.

The pumping effect performed by the ionization, acceleration and neutralizing mechanism described above is represented in FIG. 2 by an idealized ionizing pump stage 38 which conveys an ionizing gas flow $Q_i$ to the neutralizing section of the pump stage 10 and in so doing compresses the gas to the outlet pressure p2. The back diffusion from the neutralizing section back to the inlet or to the ionizing section is modeled in FIG. 2 by the backflow conduction value $L_r$ which produces a back diffusion gas flow $Q_i$. In stationary operation of the pump stage 10, the gas flow $Q_{aus}$ led off through the outlet of the pump corresponds to the incoming gas flow Q of the pump stage 10.

The gas flow Q entering through the inlet 12 and the baffle 13 is related to the inlet pressure $p_1$, the intermediate pressure $p_2$ and the admittance value LB in accordance with the equation $Q=(p_1-p_2)\cdot L_B$. A portion $Q_i(i)$ of the gas flow Q dependent on the degree of ionization i of the ionizing section (i=0 . . . 100%) is, as described above, ionized, is accelerated toward the acceleration structure, flies through the acceleration structure and is neutralized again in the neutralizing section. The back diffusion of the electrically neutral gas molecules is no longer subject to the electrical movement laws, but rather to the thermal movement laws and results as $Q_r=(p_2-(1-i)\cdot p_1')\cdot Lr$.

Starting from the above flow equations, the maximum suction capacity S0 and the idling compression $k_0$ of the pump stage 10 can be determined, wherein the $H_o$ factor $H_0$ results from the suction capacity $S_0$ and the admittance value LB in accordance with the equation $H_0=S_0/L_B$, where $H_0<100\&\%$.

The $H_o$ factor can be calculated, starting from the above-described model, as $H_o=(k_0-1)/(k_0+g)$, where g is a pump stage-specific constant whose value can e.g. be 2 and $k_o$ gives the idling compression of the pump stage 10. The idling compression $k_o$ can be determined according to the equation $k_o=1+i/(i-1)\cdot a\cdot 22{,}4\cdot(U/V)^{1/2}$. Here is a geometrical factor which depends on the length of the channels 22 (see FIG. 1) and is approximately equal to 1. The factor a in this respect increases for larger lengths L of the channels 22 here (FIG. 1) so that a larger length L of the channels 22 produces a larger idling compression $k_0$ and a larger $H_o$ factor $H_0$. U designates the amount of the acceleration voltage or of the acceleration potential which is applied to the acceleration structure and which can be selected independently of the degree of ionization.

A high $H_o$ factor can in this respect in particular be achieved with high acceleration voltages U and high degrees of ionization i. The ionizing pump stage 10 can be configured such that an idling compression $K_0$>30 is reached and simultaneously an $H_o$ factor $H_0$>90% is reached. For example, with an acceleration voltage U of 17 kV/1.9 kV/0.kV or 0.2 kV and a degree of ionization i of 1%/3%/5% or 10%, an Ho factor $H_0$>90% can be achieved. A degree of ionization of at least 3% is advantageously realized to be able to achieve an $H_o$ factor>90% even with moderate acceleration voltages U.

The $H_o$ factor of the total vacuum pump shown in FIG. 1, i.e. the effective $H_o$ factor $H_{0eff}$ determined while taking account of the further pump stage 28, depends on the suction power of the further pump stage 28 as well as on the admittance value and accordingly on the inlet size or flange size of the further pump stage 28 in comparison with the admittance value and accordingly with the inlet size or flange size of the ionizing pump stage 10, with a greater effective $H_o$ factor $H_{0eff}$ being achieved with a larger flange size of the further pump stage 28.

Figure 3:
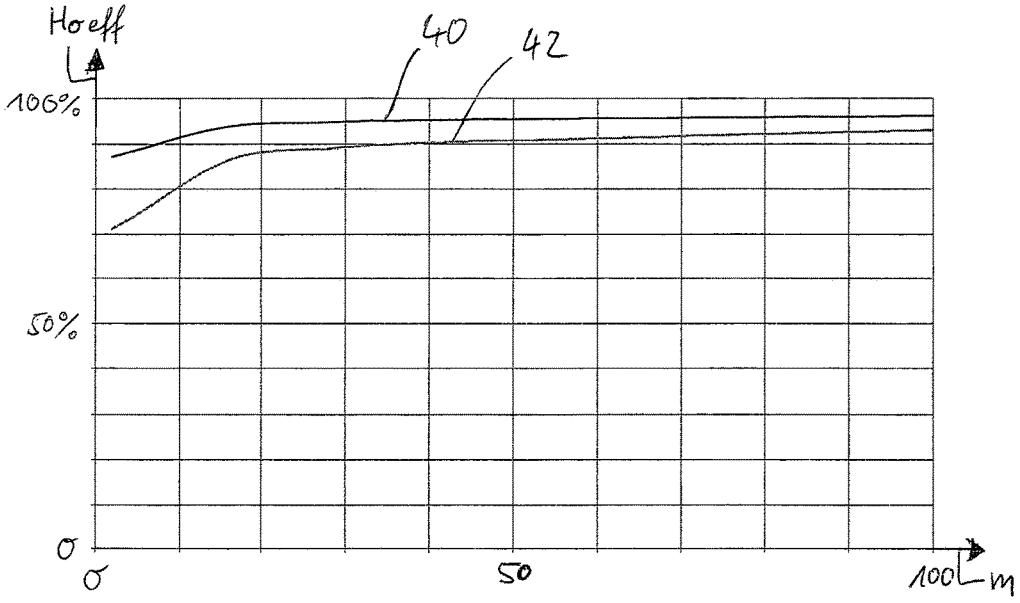
FIG. 3 exemplary characteristic lines of two vacuum pumps in accordance with a respective one embodiment of the invention.

FIG. 3 shows for comparison two exemplary characteristic lines 40, 42 which each give the effective Ho factor $H_{0eff}$ of an exemplary vacuum pump in accordance with FIG. 1 in dependence on the relative molecular mass m of the gas molecules conveyed by the pump, with both cases starting from an acceleration voltage U of 2 kV and a degree of ionization i of 10% of the ionizing pump stage 10 of the same design for both pumps. In both pumps, the further pump stage 28 (FIG. 1) is in each case formed by a turbomolecular pump stage. The characteristic line 40 describes a pump having a larger turbomolecular pump stage 28 in which the flange size of the turbomolecular pump 28 corresponds to the flange size of the ionizing pump stage 10. The characteristic line 42 describes a pump having a smaller turbomolecular pump stage 28 in which the flange size of the turbomolecular pump stage 28 is smaller by one size than the flange size of the ionizing pump stage 10.

As can be seen with reference to the characteristic lines 40, 42 in FIG. 3, a very high effective $H_o$ factor $H_{0eff}$ is achieved with both pumps, in particular also with small molecular masses m, with the effective $H_o$ factor $H_{0eff}$ being larger than 90% over a wide range of the molecular mass m, in particular with the pump having the larger turbomolecular pump stage (characteristic line 40).

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A vacuum pump, comprising at least one ionizing pump stage (10); and at least one turbomolecular pump stage (28) following the ionizing pump stage (10) in a conveying direction, wherein the ionizing pump stage (10) has:

an inlet (12) for gases entering into the pump stage (10);

an ionizing section (14) communicating with the inlet (12) in a gas-conductive manner and an ionizing device for ionizing the gas entered into the ionizing section (14);

an acceleration device (20) for accelerating the ionized gas present in the ionizing section in a conveying direction of the gas; and a neutralizing section (18) following the ionizing section (14) in the conveying direction and communicating with the ionizing section (14) in a gas-conductive manner and a neutralizing device (24) for the electrical neutralizing of the ionized gas entering into the neutralizing section (18), and wherein the ionizing device comprises an ionizing structure for ionizing the gas, and wherein the ionizing section extends, least at one point, over at least approximately a total gas-conductive cross-section of a conveying space for the gas and which is formed by the ionizing path, and the ionizing structure bounds the ionizing section of the conveying space.

2. The vacuum pump in accordance with claim 1, wherein the vacuum pump comprises a plurality of ionizing pump stages (10).

3. The vacuum pump in accordance with claim 1, wherein a plurality of ionizing pump stages (10) are connected in series or in parallel with respect to a gas flow conveyed in the conveying direction of the gas.

4. The vacuum pump in accordance with claim 1, wherein the neutralizing section (18) is substantially separated from the inlet (12) by the ionizing section (14).

5. The vacuum pump in accordance with claim 1, wherein the acceleration structure (20) is arranged in an acceleration section (16) or bounds the acceleration section (16) which is arranged in the conveying direction between the ionizing section (14) and the neutralizing section (18) and connects the ionizing section (14) and the neutralizing section (18) to one another in a gas-conductive manner.

6. The vacuum pump in accordance with claim 1, wherein the acceleration structure (20) is configured for producing an electrical acceleration field, and/or wherein the acceleration structure (20) can be acted on by an electrical acceleration potential.

7. The vacuum pump in accordance with claim 1, wherein the neutralizing structure (24) can be acted on by a neutral electrical potential.

8. The vacuum pump in accordance with claim 1, wherein gas molecules (32, 32') to be conveyed are selected from the group comprising molecules of $H_2$, $O_2$, $N_2$, CO and $CO_2$.

9. The vacuum pump in accordance with claim 1, wherein the ionizing pump stage (10) has a cylindrical basic shape.

10. The ionizing pump stage in accordance with claim 9, wherein the ionizing section (14) and the neutralizing section (18) follow one another in an axial direction or in a radial direction.

11. The vacuum pump in accordance with claim 1, wherein an outlet (26) for leading off the gas from the neutralizing section (18) is provided following the neutralizing section (18) in the conveying direction and connected to the neutralizing section (18) in a gas-conductive manner.

12. A vacuum pump stage according to claim 1, wherein the acceleration device (20) has an acceleration structure formed by a grid-shaped electrode and having a plurality of channel-shaped or tunnel-shaped openings (22), each channel-shaped or tunnel-shaped opening (22) having a length larger than both width and height of the channel-shaped or tunnel-shaped opening (22).

13. The vacuum pump stage in accordance with claim 12, wherein each channel-shaped or tunnel-shaped opening (22) has a ratio of a length thereof to a height or width thereof from 2 to 5.

14. A vacuum pump, comprising at least one ionizing pump stage (10); and at least one turbomolecular pump stage (28) following the ionizing pump stage (10) in a conveying direction, wherein the ionizing pump stage (10) has:

an inlet (12) for gases entering into the pump stage (10);

an ionizing section (14) communicating with the inlet (12) in a gas-conductive manner and an ionizing device for ionizing the gas entered into the ionizing section (14);

an acceleration device (20) for accelerating the ionized gas present in the ionizing section in a conveying direction of the gas; and a neutralizing section (18) following the ionizing section (14) in the conveying direction and communicating with the ionizing section (14) in a gas-conductive manner and a neutralizing device (24) for the electrical neutralizing of the ionized gas entering into the neutralizing section (18), wherein the ionizing device comprises an ionizing structure for ionizing the gas, and wherein the ionizing structure can be acted on by an electrical DC voltage potential or by an electrical AC voltage potential, and wherein the electrical DC or AC voltage potential is adapted to ionize the gas molecules to be pumped once or a multiple of times, with the gas molecules being selected from the group consisting of hydrogen, oxygen, nitrogen, carbon monoxide or carbon dioxide molecules.

* * * * *